US007211030B1

(12) United States Patent
Cao

(10) Patent No.: US 7,211,030 B1
(45) Date of Patent: May 1, 2007

(54) EXERCISE MACHINE HAVING FULL WEIGHT OR HALF WEIGHT SELECTION MECHANISM

(76) Inventor: Guofang Cao, 2641 Shady Ridge La., Diamond Bar, CA (US) 91765

( * ) Notice: Subject to any disclaimer, the term of this patent is extended or adjusted under 35 U.S.C. 154(b) by 0 days.

(21) Appl. No.: 11/279,429

(22) Filed: Apr. 12, 2006

(51) Int. Cl.
*A63B 21/062* (2006.01)

(52) U.S. Cl. ..... 482/99; 482/908

(58) Field of Classification Search ..... 482/92–94, 482/98–103, 138, 908
See application file for complete search history.

(56) References Cited

U.S. PATENT DOCUMENTS 3,746,338 A * 7/1973 Proctor ..... 482/101
3,815,903 A * 6/1974 Blomqvist ..... 482/103
4,648,594 A * 3/1987 Schleffendorf ..... 482/102
4,721,301 A * 1/1988 Drake ..... 482/102
5,362,290 A * 11/1994 Huang ..... 482/100
5,518,477 A * 5/1996 Simonson ..... 482/102
6,095,954 A * 8/2000 Svanberg ..... 482/99
6,551,223 B2 * 4/2003 Cheng ..... 482/99
6,582,346 B1 * 6/2003 Lines et al. ..... 482/102
7,044,897 B2 * 5/2006 Myers et al. ..... 482/99
7,150,701 B2 * 12/2006 Lines et al. ..... 482/102
2003/0060345 A1 * 3/2003 Piane ..... 482/100

* cited by examiner

*Primary Examiner*—Jerome Donnelly
*Assistant Examiner*—Victor K. Hwang
(74) *Attorney, Agent, or Firm*—Jen-Feng Lee, Esq.

(57) ABSTRACT

A exercise machine has a pulley for user's flexibility to choose between training at the selected weight plates' full weight, or at the half weight when the pulley is engaged. A latching switch is used for easy selection of going between the full weight and half weight mode. A counter weight block is attached to an end of the cable, to keep the tension of the cable when the exercise machine is used in the full weight mode.

5 Claims, 7 Drawing Sheets

EXERCISE MACHINE HAVING FULL WEIGHT OR HALF WEIGHT SELECTION MECHANISM

FIELD AND BACKGROUND OF THE INVENTION

The present invention relates generally to an improved design and construction of fitness training equipment wherein users can easily choose to select a certain desired amount of weight, or can easily choose to select half of the weight as shown by the selected weight plates.

Selectable amount of weight is commonly found on many fitness training equipment. Mostly, a cable is used on a connecting mechanism which in turns engages in the desired amount of weight plates (placed inside a steel frame) for training purpose. Prior art systems are shown in FIG. 1.

Sometimes, users of such training equipment want to have the ability to change the selected weight, not by the fixed increment of one weight plate at a time, but by half the amount of a weight plate. To accommodate such half-plate weight increment, some quantities of half-size weight plates have to be specially added to the top portion of a weight stack, or have some kind of selectable add-on weight built into the training machine.

The cost for the half-weight increment selection is oftentimes relatively high.

Present invention introduces a cost-effective way to accommodate the need for the half-size increment.

OBJECTS AND SUMMARY OF THE INVENTION

Present invention employs the physics of a pulley system, utilizing the leverage produced by a pulley, when engaged, to allow the selection of half weight as desired by users, in a very cost-effective manner.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 1:
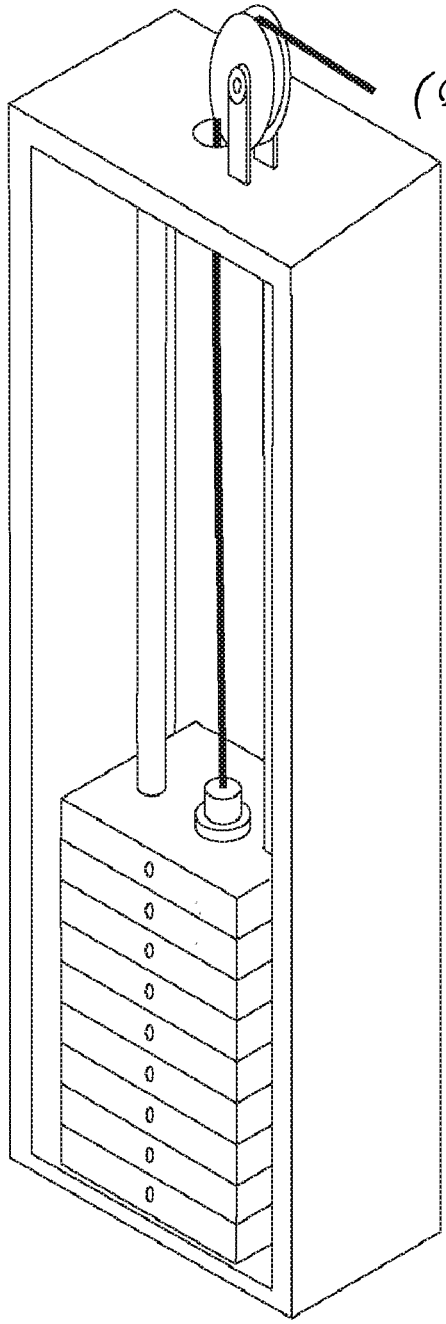
Figure 1 ( Prior Art )
FIG. 1 shows the prior art weight stack selection system.

In FIG. 1, a user pulls the desired weight by the number of selected weight plates engaged to the cable.

Figure 2:
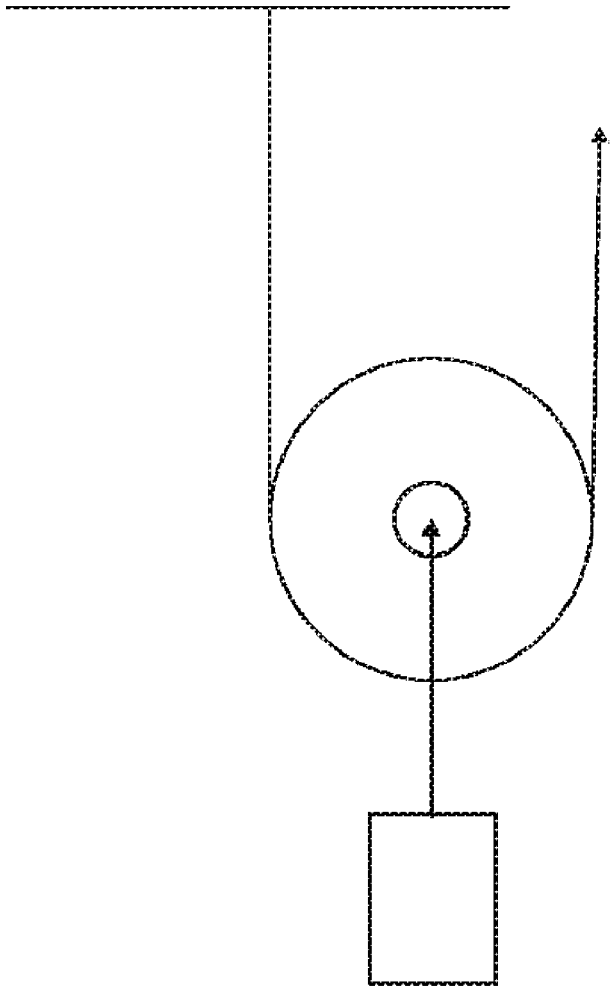
FIG. 2 shows the physical principle of using half the force to pull up a weight block when a pulley is engaged.

FIG. 2 shows the physical principle of a pulley. The arrowed force is only half of the weight block's natural G force, due to the leverage produced by a pulley.

Figure 3:
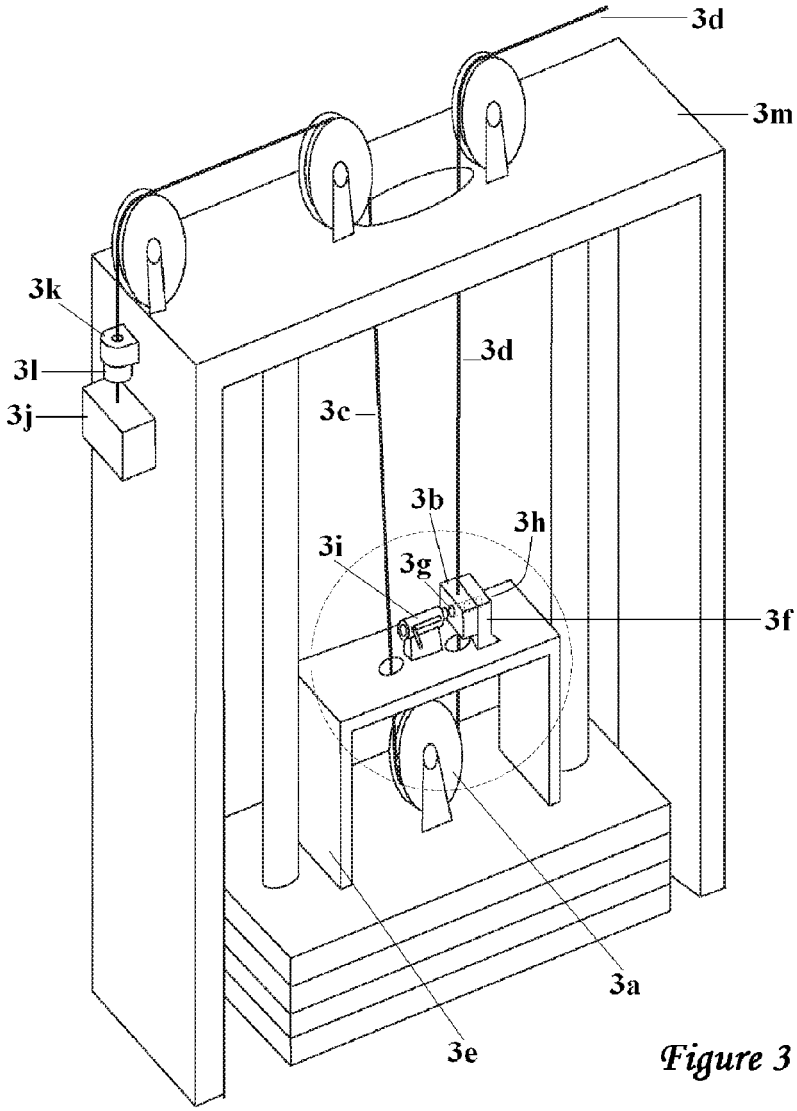
FIG. 3 shows the overall schematic of a half-weight selection pulley system of present invention.
Figure 4:
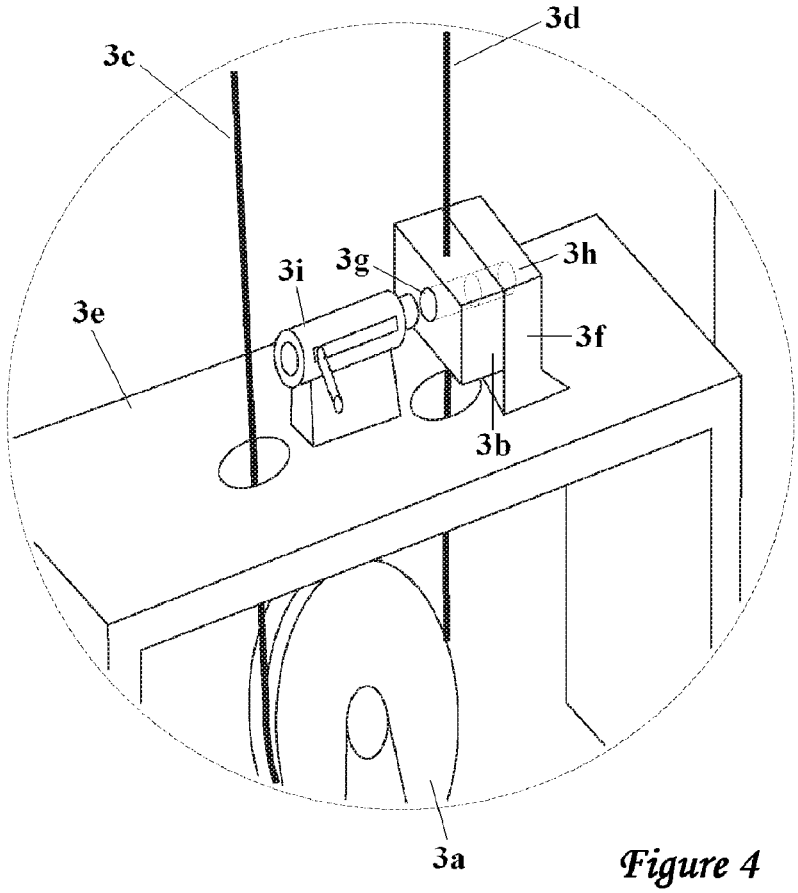
FIG. 4 shows the magnified view inside the dotted circle of FIG. 3 of present invention.

FIGS. 3 and 4 explain in details the structure of present invention based by the use of pulley to accommodate half-weight selection in a cost-effective manner.

A pulley 3*a* is fixed on the top weight plate of a plurality of weight plates housed in a frame 3*m*.

A bridge 3*e* is fixed on the top weight plate. The pulley 3*a* is located just under the bridge 3*e*. The top portion of the bridge 3*e* has two holes, allowing the two ends of a cable stringing through the pulley 3*a* and through a top portion of the frame 3*m*.

A connecting block 3*b* is fixed to the junction of the cable where the two segments of cables 3*c* and 3*d* are joined together, as denoted by present invention.

Cable segment 3*c* goes through pulley 3*a* and two holes on the bridge 3*e*, and ends with a counter weight block 3*j*. Cable segment 3*d* goes toward the end where users will apply force during normal usage.

A plurality of pulleys on the top and outside surface of the frame guides the cable segments, allowing the cable of the user-end 3*d* to be directed to any desired direction and the counter weight end 3*c* of the cable to be suspended down towards the pull of gravity.

A locking block 3*f* is fixed on the top of the bridge 3*e*. Hole 3*g* (on the connecting block 3*b*) and hole 3*h* (on the locking block 3*f*) are lined up when the weight stack is at relaxed state.

A latching switch 3*i* is fixed on top of the bridge 3*e*. The latching switch contains a center pin insertably lined up with holes 3*g* and 3*h* when the weight stack is at relaxed state.

Cable segment 3*c* goes through a frame block 3*k* and has a stop block 31 located near its end, where a counter weight block 3*j* is attached to said end of cable segment 3*c*.

Figure 6:
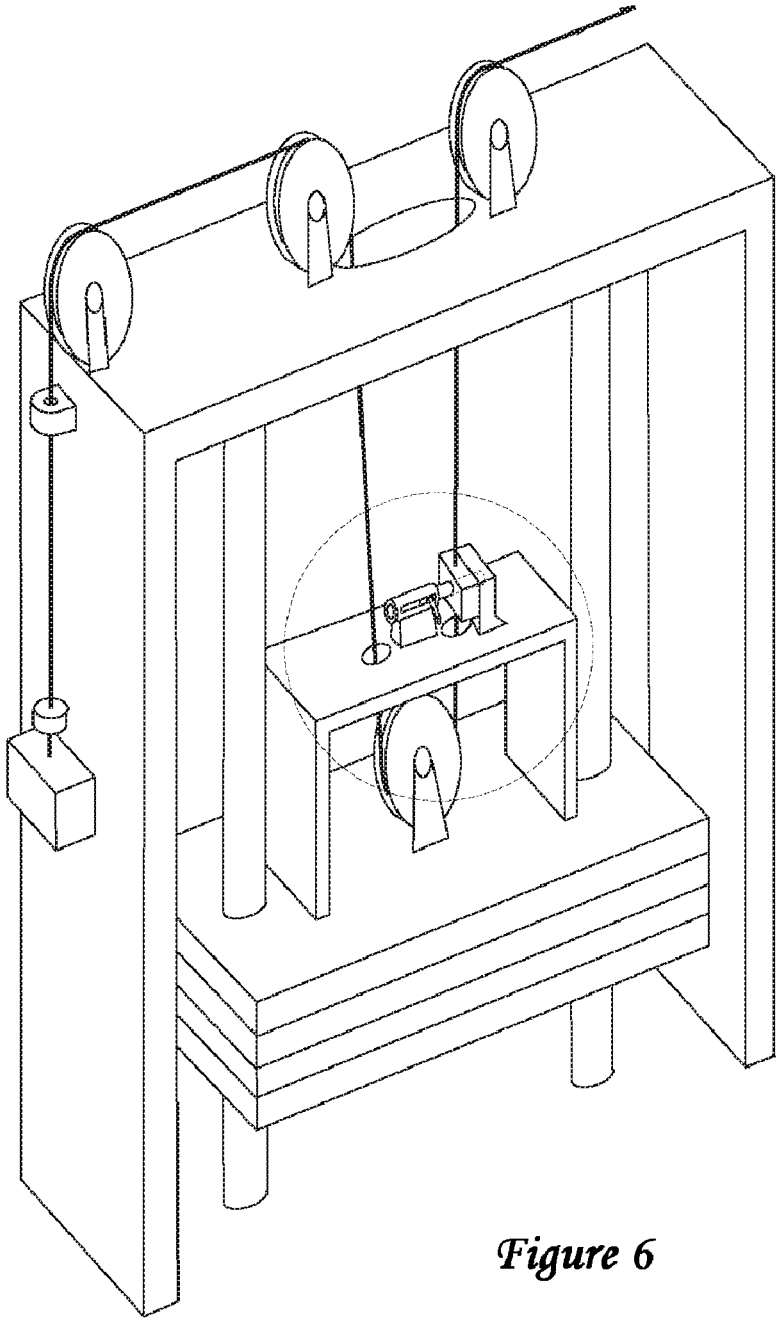
FIG. 6 shows the system is being operated in the full-weight setting, when the latching switch is in ON position, keeping the connecting block and the locking block together, and disengaging the pulley.

The purpose of counter weight block 3*j* is to keep the cable segment 3*c* in a tensioned state when the system is working in the full-weight mode, having the latching switch in a ON position, as shown in FIG. 6.

Figure 5:
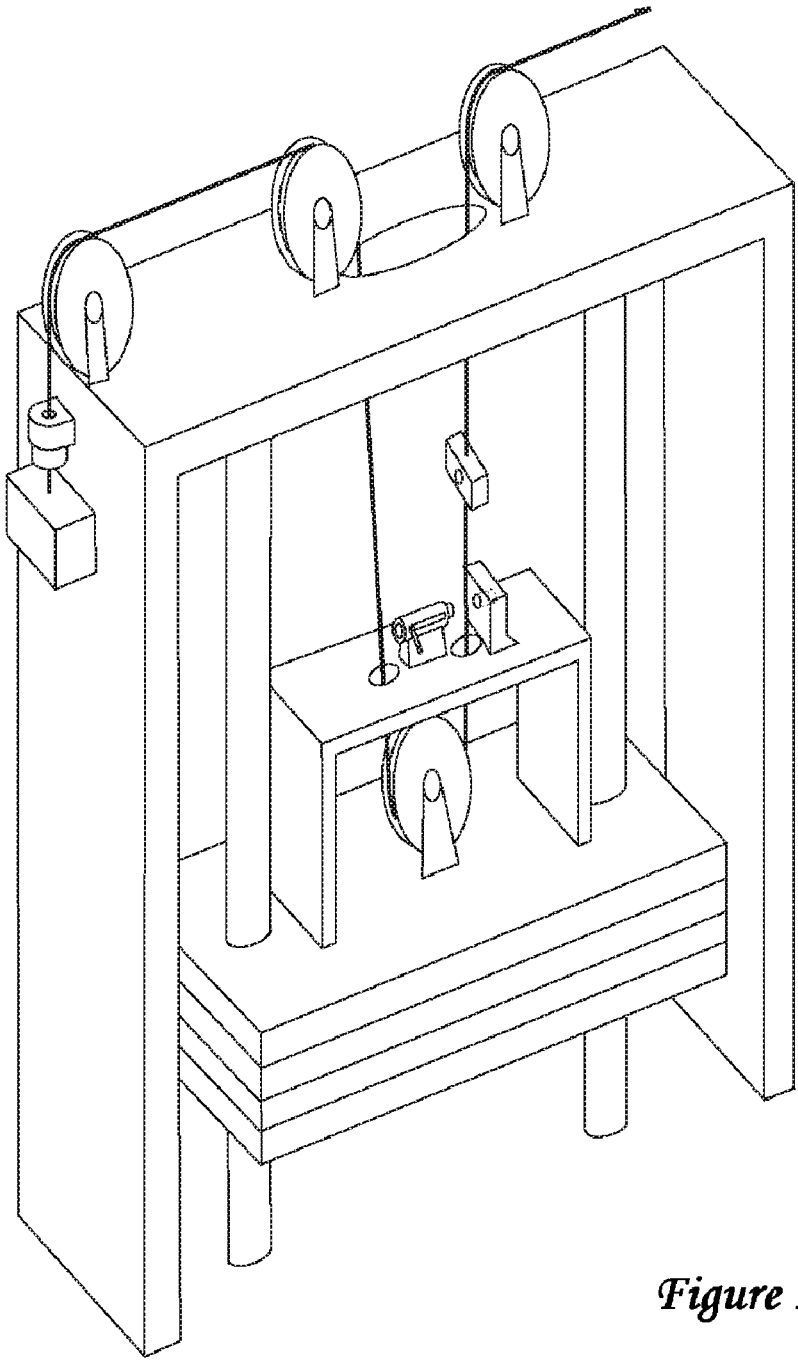
FIG. 5 shows the system is being operated in the half-weight setting, when the latching switch is in OFF position, engaging the pulley to produce the power leverage.

For half-weight setting: when latching switch 3*i* remains out of the holes 3*g* (of connecting block 3*b*) and 3*h* (of locking block 3*f*), said latching switch is in OFF position, the pulley 3*a* is engaged. In this setting, see FIG. 5, the stop block 31 (on cable segment 3*c*) will be drawn up to the bottom of frame block 3*k* when the fitness equipment is in use. Users are pulling HALF of the weight of the selected weight plates, due to the physical consequence of engaging pulley 3*a*.

Figure 7:
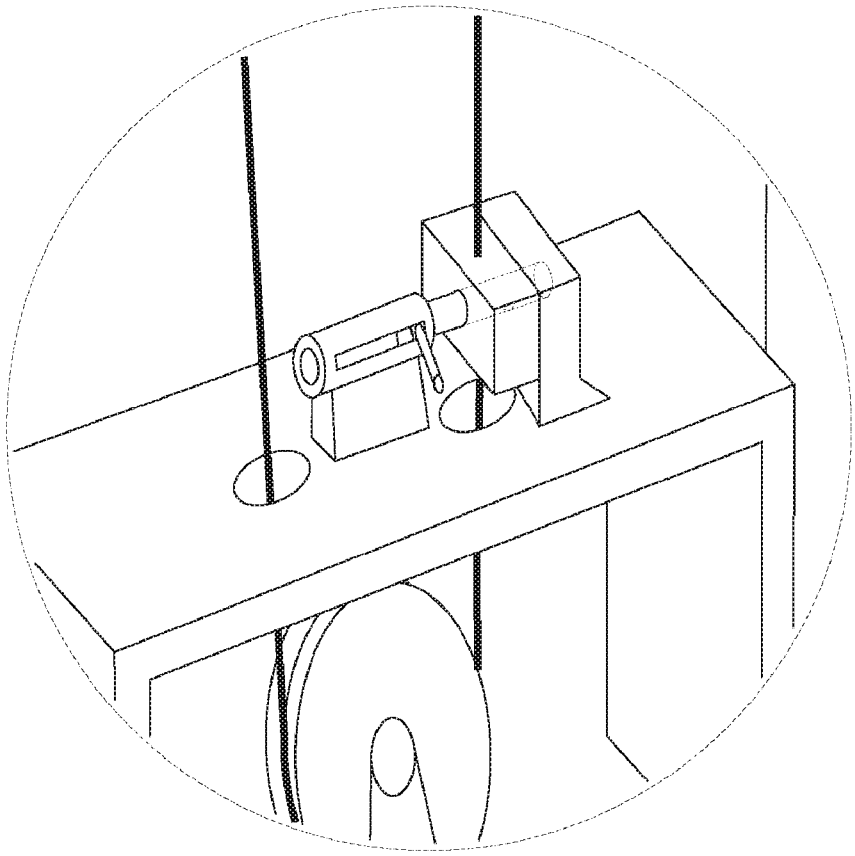
FIG. 7 shows the magnified view inside the dotted circle of FIG. 6 of present invention.

For full-weight setting: when latching switch 3*i* is inserted through hole 3*g* and into hole 3*h*, the connecting block 3*b* and locking block 3*f* are locked together. In this setting, see FIGS. 6 & 7, cable segment 3*c* will be kept tight by the counter weight block 3*j*. In this state (full-weight), cable segment 3*d* is pulled by users and the complete stack is pulled up by the locking block 3*f* which is connected to bridge 3*e*, which is connected to top plate. In this state, as shown in FIGS. 6 & 7, pulley 3*a* does not produce the physical leverage.

Although the description herein states the cable segment 3*c* is connected to a bridge 3*e* and then to top plate, the same implementation can be applied when the pulley 3*a* and bridge 3*e* are connected to the top of a central stem having an associated insertion pin for selection of desired weight by choosing to insert into a specific weight plate within the vertical range of the central stem, for the commonly found central stem system as shown in the prior art FIG. 1. The stop block 31 and the counter weight block 3*j* may be combined into an integrated clock serving both as counter weight when the pulley is disengaged in full weight usage mode and as cable tensioner when the pulley is engaged in half weight usage mode.

Thus, by the design of present invention, users can easily choose to lift the full or the half weight of the selected weight plates.

What is claimed is:

1. Exercise machine having full weight or half weight selection mechanism, comprising:

a. a plurality of weight plates housed in a frame;

b. a bridge on the top weight plate;

c. a pulley on the top weight plate under said bridge; and d. a cable stringing around said pulley through holes on the bridge and through the top portion of said frame, allowing users of exercise machine to pull the first end of said cable when used in training, resulting in the use of half force as indicated by the selected weight plates.

2. Exercise machine of claim 1 wherein said top plate is in the form of a central stem having associated insertion pin for selection of desired weight by choosing to insert into specific weight plate within the vertical range of said central stem.

3. Exercise machine of claims 1 or 2, further comprising:

a. a counter weight block and a stop block on a second end of said cable;

b. a frame block on the outside of said frame, so that second end of said cable is strung through said frame block, allowing said counter weight block to pull the cable tight;

c. a latching switch on top of said bridge;

d. a connecting block on said cable; and, e. a locking block on top of said bridge, so that a pin of said latching switch can be slidably inserted through a hole in said connecting block and into a hole in said locking block, resulting in said connecting block going up and down in synch with the up and down of the weight plates when said latching switch pin is latched into the holes in said connecting block and said locking block, and resulting in said connecting block going up and down in twice the travel as the up-down travel of the weight plates when said latching switch pin is not latched into the hole of said connecting block.

4. The exercise machine of claim 3, further comprising a plurality of pulleys on top and outside surface of said frame to guide the cable, allowing cable of the user-end to be directed to any desired directions and the counter weight end of said cable to be suspended down towards the gravity pull.

5. The exercise machine of claim 3, wherein said stop block and said counter weight block may be combined into an integrated block, serving both as counter weight when the pulley is disengaged in full weight usage mode and as cable tensioner when the pulley is engaged in half weight usage mode.

* * * * *